US008444498B2

(12) United States Patent
Grossman

(10) Patent No.: US 8,444,498 B2
(45) Date of Patent: May 21, 2013

(54) SEESAW

(75) Inventor: Martin Grossman, Glasgow (GB)

(73) Assignee: H Grossman Ltd., Rutherglen, Glasgow (GB)

( * ) Notice: Subject to any disclaimer, the term of this patent is extended or adjusted under 35 U.S.C. 154(b) by 308 days.

(21) Appl. No.: 12/811,093

(22) PCT Filed: Dec. 30, 2008

(86) PCT No.: PCT/GB2008/004299

§ 371 (c)(1),
(2), (4) Date: Sep. 9, 2010

(87) PCT Pub. No.: WO2009/083728

PCT Pub. Date: Jul. 9, 2009

(65) Prior Publication Data

US 2011/0059805 A1 Mar. 10, 2011

(30) Foreign Application Priority Data

Dec. 31, 2007 (GB) ..... 0725367.7

(51) Int. Cl.
*A63G 11/00* (2006.01)
*A63G 1/00* (2006.01)

(52) U.S. Cl.
USPC ..... 472/106

(58) Field of Classification Search
USPC ..... 472/106–115, 118, 119
See application file for complete search history.

(56) References Cited

U.S. PATENT DOCUMENTS

| | | | | |
|---|---|---|---|---|
| 2,113,488 | A | 4/1938 | Milton | |
| 3,107,913 | A | 10/1963 | Rouse | |
| 5,356,329 | A | 10/1994 | Thornell | |
| 5,951,406 | A | 9/1999 | Steane | |
| 6,379,256 | B1 | 4/2002 | Gatto | |
| 6,416,381 | B1 | 7/2002 | Walter | |
| 6,454,658 | B1 | 9/2002 | Drouin | |
| 6,533,672 | B1 | 3/2003 | Keller et al. | |
| 6,908,397 | B2 * | 6/2005 | Armbruster et al. | 472/119 |
| 2004/0082396 | A1 | 4/2004 | Basu | |

FOREIGN PATENT DOCUMENTS

| | | |
|---|---|---|
| WO | WO/95/32778 | 12/1995 |
| WO | WO/2007/026477 | 3/2007 |
| WO | WO-2007/080370 | 7/2007 |

* cited by examiner

*Primary Examiner* — Kien Nguyen
(74) *Attorney, Agent, or Firm* — Owens Tarabichi LLP

(57) ABSTRACT

A seesaw having a plurality of illumination means provided on both sides of a pivotable elongate member. The illumination means are controlled by control means dependent upon the inclination of the elongate member.

38 Claims, 4 Drawing Sheets

SEESAW

This application claims priority to prior filed foreign application GB 07 25 367.7, filed on Dec. 31, 2007, the entirety of which is hereby incorporated by reference herein.

FIELD OF INVENTION

This invention relates to play equipment or apparatus, such as seesaws. The invention particularly relates to an improved seesaw having illumination means or lights.

BACKGROUND TO INVENTION

Seesaws—sometimes called see saws, see-saws or teeter-totters, are known. Seesaws are typically found in public or common spaces, such as play parks, play areas, or play grounds, and in private or residential spaces, such as gardens or yards.

Whilst children are often eager to play on seesaws, repeated or prolonged play can render a seesaw disinteresting to a child.

It is an object of at least one embodiment of at least one aspect of the present invention to seek to obviate or at least mitigate one or more problems/disadvantages in the prior art.

It is an object of at least one embodiment of at least one aspect of the present invention to seek to provide an improved seesaw.

It is an object of at least one embodiment of at least one aspect of the present invention to seek to provide a seesaw having a novel or novelty lighting or illumination effect or arrangement. By such arrangement a seesaw may become more desirous or attractive to a user(s).

It is an object of at least one embodiment of at least one aspect of the present invention to seek to provide an improved seesaw which provides an enhanced play experience, and which may facilitate play between at least two persons, such as infants or children.

It is an object of at least one embodiment of at least one aspect of the present invention to seek to provide an improved seesaw having better visibility than seesaws of the prior art. Such may be of use in improving safety and/or allowing play outdoors at night or indoors in a darkened space.

SUMMARY OF INVENTION

According to a first aspect of the present invention there is provided a seesaw, teeter totter or play equipment comprising at least one illumination means.

The seesaw may comprise a base portion and first and second end portions spaced in opposingly distal relation to the base portion.

The seesaw may comprise means for allowing at least simultaneous opposing vertical (up and down, and down and up) movements of the first and second end portions. The seesaw may be moveable or pivotable around a horizontal transverse axis between the first and second end portions.

The seesaw may comprise means for selectively controlling the illumination means dependent upon a position of the first and/or second end portions.

The first and second end portions may comprise respective first and second mounting or seating means.

The mounting or seating means may allow a user to sit (or perhaps kneel or stand) on the seesaw.

First and second handle means and/or first and second footrest means may be provided on or adjacent to the first and second mounting or seating means.

Preferably the at least one illumination means comprises a plurality of illumination means. The seesaw or equipment may comprise an elongate member.

The elongate member may be pivotable around the base portion, and the base portion may be fixed relative to the ground.

Beneficially the illumination means may be provided spaced, e.g. substantially equally spaced, along the elongate member.

In use, movement or inclination of the elongate member may selectively control operation of the illumination means, e.g. by means of the selective control means in the form of a tilt control or switch means.

In one embodiment the seesaw may comprise a base or base member.

The elongate member may be attached to the base by a tilt or pivot means. In this way the elongate member may be movable at least in a pivoting movement relative to the base, e.g. relative to a substantially horizontal transverse axis. In a modification the elongate member may also be moveable in a rotational movement relative to the base, e.g. relative to a substantially vertical axis.

In another embodiment the elongate member may comprise or be associated with a cradle or rocking means which may comprise an actuate base portion.

The illumination means may be provided on or in the elongate member.

For example, and preferably, where the illumination means comprises a plurality of illumination means, the illumination means may be provided along the elongate member. For example, the illumination means may be provided in a spaced, e.g. substantially equally spaced, relation along the elongate member.

The elongate member may comprise a first side or end on one side of the pivot means and a second side or end on the other side of the pivot means.

Preferably the illumination means are disposed, e.g. substantially symmetrically, on the elongate member on either or preferably both sides thereof.

The/each illumination means may comprise a light emitting diode (LED).

The/each/at least some of the illumination means may be provided on or adjacent a topmost or at least partially upper facing surface or portion of the elongate member. By such arrangement the illumination means may, in use, be seen or viewed by a user(s) seated at one end of the seesaw, and optionally by a further user(s) seated at another end of the seesaw.

The/each/at some of the illumination means may be provided within the elongate member adjacent a respective hole/aperture/window.

The elongate member may be at least partly hollow or tubular, and the illumination means may be provided adjacent a/the respective hole/aperture/window.

The/each/at least some of the or further illumination means may be provided at or adjacent first and second ends of the elongate member. For example, seat means may be provided at either end of the elongate member, and the/each/at least some of the illumination means may be provided on the/each seat means, e.g. around a peripheral portion(s) thereof.

There may be provided means for controlling the illumination means.

The control means may comprise tilt or angle detection means, e.g. means for detecting tilt or an angle of the elongate member.

The illumination means may be in a first illumination arrangement when the first end portion is above the second end portion.

The illumination means may be in a second illumination arrangement when the second end portions is above the first end portion.

The first and/or second illumination arrangements of the illumination means may be static or dynamic, e.g. flashing or chasing.

In one implementation the control means may control or switch, e.g. selectively switch, the illumination means such that one or more illumination means on one end of the elongate member is/are on or illuminated, e.g. for all or at least part of a time period, when the one end is up, and one or more illumination means on the other end of the elongate member is/are off or not illuminated, e.g. for all or at least part of a further time period, when the other end is down.

In use, when the one end is moved down and the other end is moved up, at least some of the illumination means on the one end switch off, and the illumination means on the other end switch on. Such switching may beneficially occur when the elongate member is substantially horizontal.

In an alternative implementation the control means may control or switch the illumination means such that one or more illumination means on one end of the elongate member is/are off or not illuminated, e.g. for all or at least part of a time period, when the one end is up, and one or more illumination means on the other end of the elongate member is/are on or illuminated, e.g. for all or at least part of a further time period, when the other end is down.

In use, when the one end is moved down and the other end is moved up, the illumination means on the one end switches on, and the illumination means at the other end switches off. Such switching may beneficially occur when the elongate member is substantially horizontal.

In either embodiment in a mid position when the end portions are at substantially the same level, one or more of the illumination means on both end portions may be on or alternatively off.

In use, when on or illuminated the illumination means may illuminate continuously or intermittently, or flash one or more times.

In a further alternative implementation the illumination means may be controlled by the control means independent of the orientation or tilt of the elongate member.

For example, the illumination means may be caused to operate sequentially, e.g. in a "chaser" fashion, e.g. one illumination means switching on or off before or after an adjacent illumination means switches on or off.

There may be provided a switch means for a user to select between an off position and at least one on position, e.g. at least one of the said one implementation, the said alternative implementation and the said further alternative implementation.

There may be provided further illumination means, e.g. on or adjacent one or both ends of the elongate member, e.g. on seat means, which are illuminated continuously or are caused to flash, in use. The further illumination means may operate independent of or dependent upon tilt of the elongate member.

The tilt or pivot means may allow the elongate member to pivot or tilt about the base, e.g. when one end of the elongate member is down the other end is up, and vice versa, in a manner conventional to seesaws.

The tilt or pivot means may also allow the elongate member to rotate around the base, e.g. so as to allow a rotational motion of the elongate member in a plane parallel to the ground.

The illumination means may be powered by one or more batteries or cells. Alternatively or additionally the illumination means may be powered by solar power means.

The elongate member and/or the base may be made from a metal, metals or metallic materia, e.g. tubular metal.

A/the seat(s) may be made from plastic or alternatively wood or alternatively metal, metals, or metallic material.

According to a second aspect of the present invention there is provided a play apparatus or equipment, such as a seesaw, comprising a pivotable elongate member and at least one illumination means or light.

Features of the second aspect may be common with that of the first aspect of the present invention in any combination, and for reasons of conciseness are not repeated herein.

According to a third aspect of the present invention there is provided an illumination means or elongate member adapted for use in or when used in a seesaw according to either the first or second aspects of the present invention.

BRIEF DESCRIPTION OF DRAWINGS

Embodiments of the present invention will now be described by way of example only, and with reference to the accompanying drawings, which are.

DETAILED DESCRIPTION OF DRAWINGS

Figure 1:
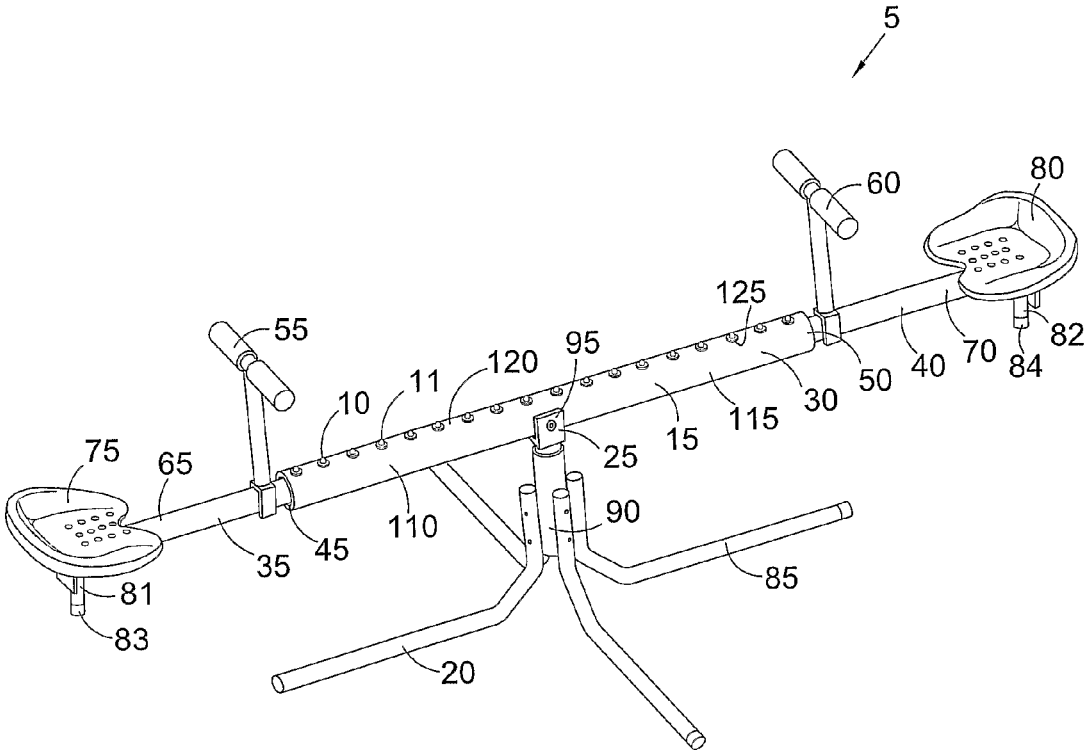
FIG. 1 a perspective view from one side, to one end and above of a seesaw according to a first embodiment of the present invention.
Figure 2:
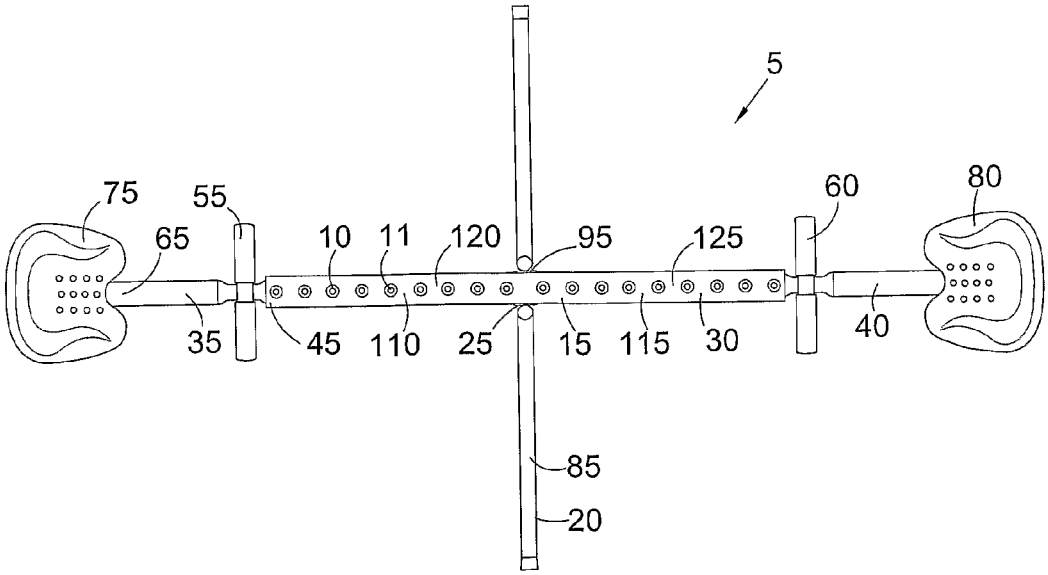
FIG. 2 a view from above of the seesaw of FIG. 1.
Figure 3:
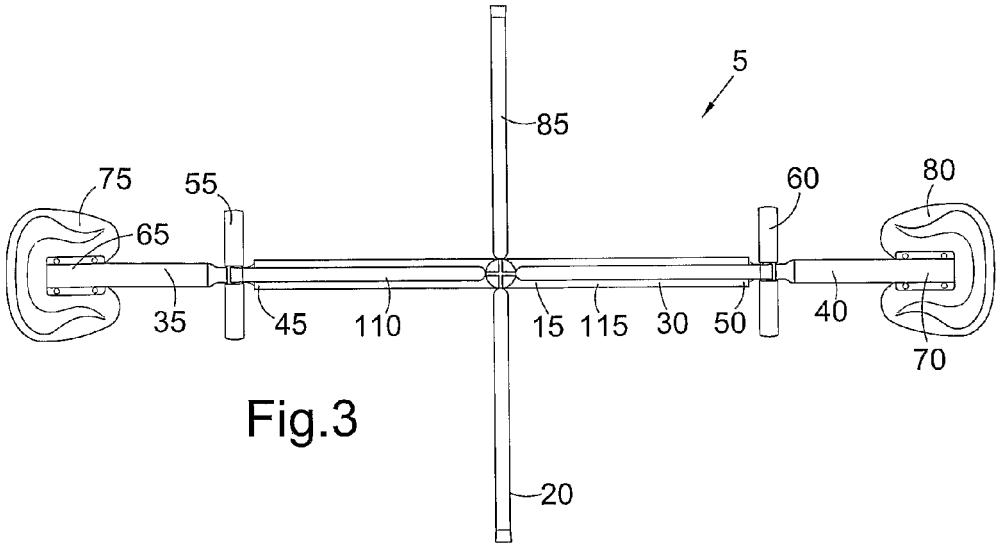
FIG. 3 a view from below of the seesaw of FIG. 1.
Figure 4:
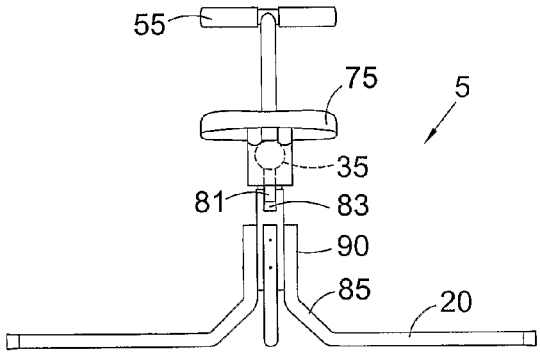
FIG. 4 a view from an end of the seesaw of FIG. 1.
Figure 5:
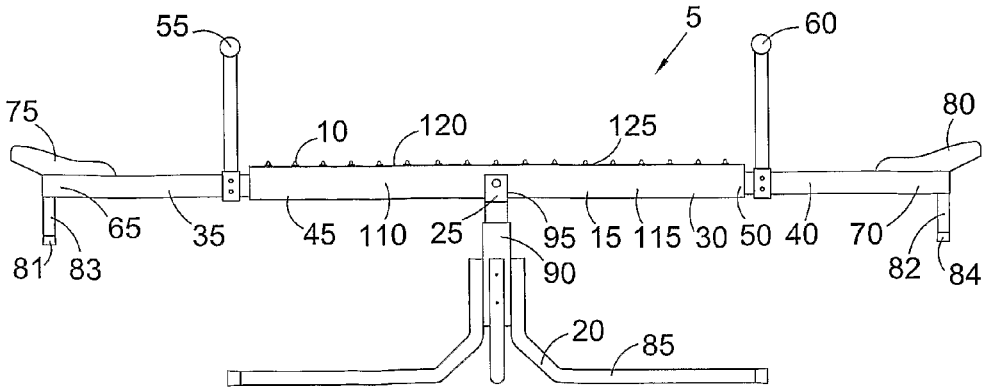
FIG. 5 a side view of the seesaw of FIG. 1.

Referring to FIGS. 1 to 7, there is shown a seesaw or play equipment, generally designated 5, according to a first embodiment of the present invention. The seesaw 5 comprises at least one illumination means 10.

The seesaw 5 comprises a base portion and first and second end portions spaced in opposing distal relation to the base portion. The seesaw 5 comprises means for allowing at least simultaneous opposing vertical movements of the first and second end portions. The seesaw 5 is moveable or pivotable around a horizontal transverse axis between the first and second end portions.

As will be described in more detail hereinafter, the seesaw 5 comprises means for selectively controlling the illumination means dependent upon a position of the first and/or second end portions. The first and second end portions comprise respective first and second mounting or seating means. The mounting or seating means allows a user or users to sit on the seesaw 5. First and second handle means and optionally first and second foot rest means (not shown) are provided on or adjacent to the first and second mounting or seating means.

The at least one illumination means 10 comprises a plurality of illumination means 11 which may be of a single colour or a plurality of colours.

The seesaw 5 comprises an elongate member 15 and a base 20. The elongate member 15 is attached to the base member 20 by a tilt or pivot means 25. The elongate member 15 comprises a tubular member 30, and first and second end tubular members 35, 40. The end tubular members 35,40 are received and retained within respective ends 45, 50 of the tubular member 30.

Each end of the elongate member 15 is provided with a handle 55, 60, which in this embodiment is fixed to the respective end tubular member 35, 40. Also provided at or adjacent ends 65, 70 of the elongate member 15 are seats 75, 80, which in this embodiment are fixed to the respective end tubular members 35, 40.

Further provided at or adjacent ends 65,70 of the elongate member 15 are downstand members 81, 82 carrying stop members 83, 84, e.g. rubber stop members.

The base 20 comprises a plurality of tubular legs 85 fixed to an upstand 90 carrying a yoke 95. The elongate member 15 is fixed within the yoke 95 by a bolt 100 and nut 105, and the yoke 95, bolt 100 and nut 105 therefore act as the pivot means 25.

The illumination means 10 are provided on or in the elongate member 15. Indeed, the illumination means 10 comprises a plurality of illumination means, the illumination means 10 being provided along the elongate member 15. The illumination means 10 are provided in a spaced, i.e. substantially equally spaced, relation along the elongate member 15.

The elongate member comprises a first side 110 on one side of the pivot means 25 and a second side 115 on the other side of the pivot means 25.

The illumination means 10 are disposed substantially symmetrically on the elongate member 15 on either side 110, 115 thereof. Each illumination means 10 comprises a light emitting diode (LED). Each LED is a round column with flange LED, e.g. made from InGaN or AlGaInP in a water clear package and having an emission colour such as ultrabright blue or ultrabrigtht orange red.

The illumination means 10 are provided on or adjacent a topmost or at least partially upper facing surface or portion 120 of the elongate member 15. By such arrangement the illumination means 10 are, in use, seen or viewable by a user(s) seated at one or each end 65, 70 of the seesaw 5. The illumination means 10 are provided within the elongate member 15 adjacent a respective hole, aperture or window 125. The elongate member 15 is at least partly hollow or tubular, and the illumination means 10 are provided or mounted adjacent a/the respective hole, aperture or window 125.

There are provided means 135 for controlling the illumination means 10, and optional further illumination means 130.

Figure 7:
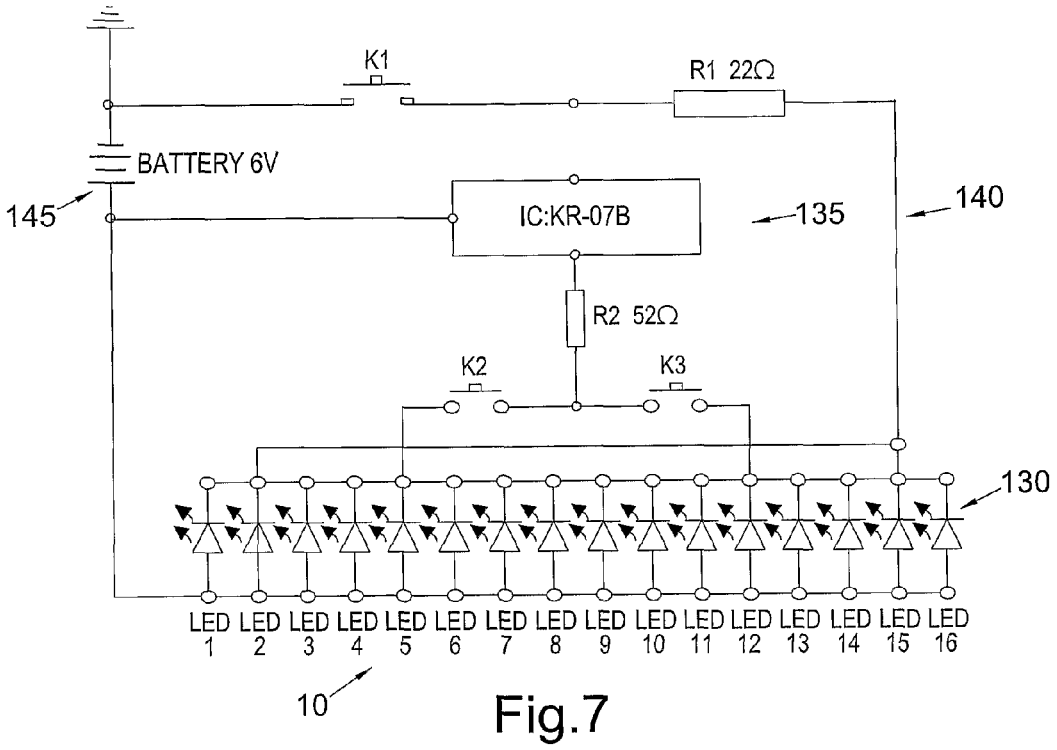
FIG. 7 a circuit diagram of circuitry of the seesaw of FIG. 1.

Referring to FIG. 7 the illumination means 10 and optional further illumination means 130 comprise part of an electronic circuit 140. The circuit 140 comprises a switch K1 which is conveniently located on the seesaw 5, e.g. below seats 75.

The circuit 140 also comprises a power source, e.g. batteries 145 and resistors R1, and R2. The circuit also comprises switches K1 and K2 associated respectively with illumination means 10 provided on one end and the other end of the elongate member 10.

The control means 135 comprises an integrated circuit 140 and tilt or angular detection means 145, i.e. means for detecting tilt of the elongate member 10.

In one implementation the control means 135 controls or switches the illumination means 10 via switches K1 and K2, such that one or more illumination means 10 on one end 65 of the elongate member 10 are on or illuminated when the one end 65 is up, and one or more illumination means 10 on the other end 70 of the elongate member 10 are off or not illuminated when the other end 70 is down. In use, when the one end 65 is moved down and the other end 70 is moved up, one or more illumination means 10 on the one end 65 switch off, and one or more illumination means 10 on the other end switch on.

In an alternative implementation the control means 135 controls or switch the illumination means 10 such that one or more illumination means 10 on one end 65 of the elongate member 10 are off or not illuminated when the one end 65 is up, and one or more illumination means 15 on the other end 70 of the elongate member 10 are on or illuminated when the other end 70 is down. In use, when the one end 65 is moved down and the other end 70 is moved up, one or more illumination means 10 on the one end 65 switch on, and one or more illumination means 10 at the other end 70 switch off.

In either implementation in a mid position when the ends 65, 70 are substantially level, the illumination means 10 on both ends 65, 70 can be on or alternatively off. Alternatively the mid position can comprise a point of switching from switch K1 to switch K2 operating, or vice versa.

In a further alternative implementation the illumination means 10 can be controlled by the control means 135 independent of the orientation or tilt of the elongate member 10.

In use, in any implementation when illuminated the illumination means 10 can illuminate continuously or intermittently, e.g. flash. In any of the implementations the illumination means 10 can be caused to operate simultaneously or sequentially, e.g. in a "chaser" fashion, e.g. one illumination means 10 switching on or off before or after an adjacent illumination means 10.

Such choice of operational implementation of the illumination means 10 can be selected by a user by providing the switch K1 with a plurality of position settings.

The tilt or pivot means 25 allow the elongate member 15 to pivot about the base 20, e.g. when one end 65 of the elongate member 15 is down the other end 70 up, and vice versa, in a manner conventional to seesaws. In a modification the tilt or pivot means 25 can also allow the elongate member 15 to rotate around the base 20, e.g. so as to allow a rotational motion of the elongate member 15 in a plane parallel, to the ground.

In this embodiment the illumination means 10 are powered by one or more batteries 140. Alternatively or additionally the illumination means 10 can be powered by solar power means.

Typically the elongate member 15 and the base 20 are made from metal, e.g. tubular metal. Further, the seats 70, 80 are made from plastic or alternatively wood.

Figure 6:
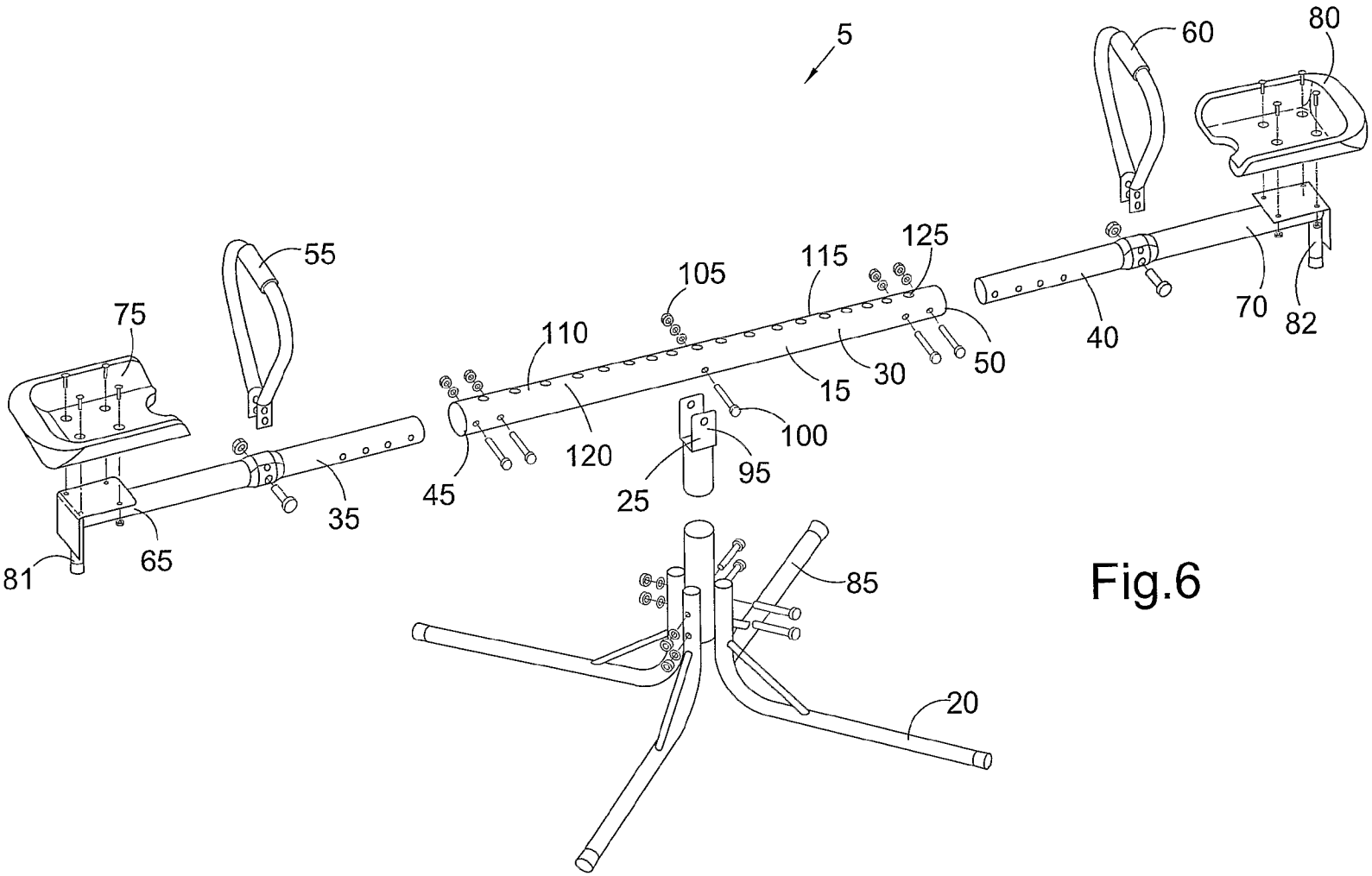
FIG. 6 an exploded perspective view of the seesaw of FIG. 1 according to a first modification.

As can be seen from FIG. 6 the various component parts of the seesaw 5 are fixed together by bolts, nuts, screws or the like. FIG. 6 shows an alternative handle 55,60 shape.

Figure 8:
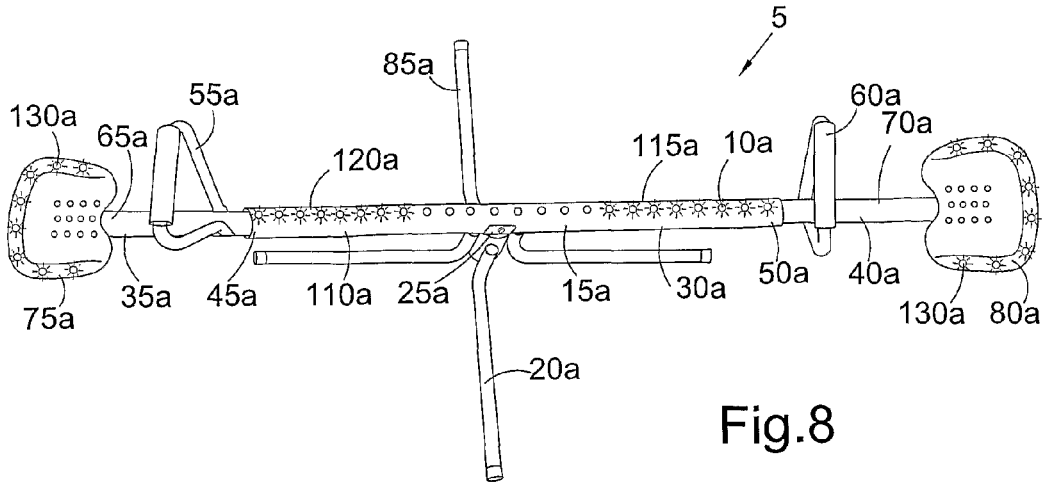
FIG. 8 a view from above of a seesaw according to a second embodiment of the present invention in an illuminated state.

Referring now to FIG. 8 there is shown a seesaw or play equipment, generally designated 5*a*, according to a second embodiment of the present invention. The seesaw 5*a* of the second embodiment is similar to the seesaw 5 of the first embodiment, like parts being denoted by like numerals but suffixed "a".

The seesaw 5*a* comprises further illumination means 130*a*, which are provided at or adjacent the first and second ends 65*a*, 70*a* of the elongate member 10*a*. Particularly seats 75*a*, 80*a* are provided at either end 65*a*, 70*a* of the elongate member 10*a*, and the further illumination means 130*a* are provided on each seat 75*a*, 80*a*, e.g. around peripheral portions thereof. Such further illumination means 130*a* can be, in use, either statically illuminated or selectably controlled by the control means in a similar or corresponding fashion to illumination means on the same end portion.

It will be appreciated that the embodiments of the present invention hereinbefore described are given by way of example only, and are not meant to be limiting to the scope of the invention in any way. It will be understood that the present invention may be used indoors or outdoors in daylight or lit conditions, wherein the illuminated illumination means are visible. Alternatively or additionally, the present invention may be used at night or in the evening outdoors or at any time indoors, such as in darkened ambient lighting conditions.

The invention claimed is:

1. A seesaw or play equipment comprising:

an elongate member;

a pivot means;

and at least one illumination means;

wherein the elongate member comprises a first end on one side of the pivot means and a second end on another side of the pivot means;

wherein the at least one illumination means comprises a plurality of illumination means;

and wherein the plurality of illumination means are disposed on the elongate member on either end thereof.

2. A seesaw as claimed in claim 1, wherein the seesaw comprises a base portion and first and second end portions spaced in opposingly distal relation to the base portion.

3. A seesaw as claimed in claim 2, wherein the seesaw comprises means for allowing at least simultaneous opposing vertical movements of the first and second end portions.

4. A seesaw as claimed in claim 2, wherein the seesaw is moveable or pivotable around a horizontal transverse axis between the first and second end portions.

5. A seesaw as claimed in claim 2, wherein the seesaw comprises means for selectively controlling the illumination means dependent upon a position of at least one of the first and second end portions.

6. A seesaw as claimed in claim 2, wherein the first and second end portions comprise respective first and second mounting or seating means.

7. A seesaw as claimed in claim 2, wherein, in use, the illumination means are in a first illumination arrangement when the first end portion is above or level with the second end portion, and the illumination means are in a second illumination arrangement when the second end portion is above or level with the first end portion.

8. A seesaw as claimed in claim 1, wherein plurality of illumination means are spaced along the elongate member.

9. A seesaw as claimed in claim 8, wherein, in use, movement or inclination of the elongate member selectively controls operation of the illumination means.

10. A seesaw as claimed in claim 8, wherein the illumination means are provided on or in the elongate member.

11. A seesaw as claimed in claim 10, wherein the illumination means are provided along the elongate member.

12. A seesaw as claimed in claim 11, wherein the illumination means are provided in equally spaced relation along the elongate member.

13. A seesaw as claimed in claim 8, wherein the illumination means are disposed substantially symmetrically on the elongate member on either end thereof.

14. A seesaw as claimed in claim 13, where the/each illumination means comprises a light emitting diode (LED).

15. A seesaw as claimed in claim 8, wherein the/each/at least some of the illumination means are provided on or adjacent a topmost or at least partially upper facing surface or portion of the elongate member.

16. A seesaw as claimed in claim 15, wherein the control means control or switch the illumination means such that one or more illumination means on one end of the elongate member are on or illuminated when the one end is up, and one or more illumination means on the other end of the elongate member are off or not illuminated when the other end is down.

17. A seesaw as claimed in claim 16, wherein in use, when the one end is moved down and the other end is moved up, the illumination means on the one end switches off, and the illumination means on the other end switches on.

18. A seesaw as claimed in claim 16, wherein in a mid position when both end portions are at substantially the same horizontal level, the illumination means on both end portions are either on or off.

19. A seesaw as claimed in claim 8, wherein the or each or some of the illumination means are provided within the elongate member adjacent a respective hole or aperture or window.

20. A seesaw as claimed in claim 8, wherein the elongate member is at least partly hollow or tubular, and the illumination means are provided adjacent a respective hole or aperture or window.

21. A seesaw as claimed in claim 8, wherein the or each or at least some of the or further illumination means is provided at or adjacent first and second ends of the elongate member.

22. A seesaw as claimed in claim 21, wherein seat means are provided at either end of the elongate member, and the or each or at least some of the illumination means are provided on the/each seat means, such as around a peripheral portion(s) thereof.

23. A seesaw as claimed in claim 8, wherein the elongate member and/or the base are made from metal.

24. A seesaw as claimed in claim 1, wherein the seesaw comprises a base, which is optionally and beneficially fixed relative to the ground.

25. A seesaw as claimed in claim 1, wherein an elongate member is attached to a base by a tilt or pivot means.

26. A seesaw as claimed in claim 25, wherein the tilt or pivot means allows the elongate member to pivot about the base, such that when one end of the elongate member is down the other end is up, and vice versa.

27. A seesaw as claimed in claim 25, wherein the tilt or pivot means allow the elongate member to rotate around the base.

28. A seesaw as claimed in claim 1, wherein there are provided means for controlling the illumination means.

29. A seesaw as claimed in claim 28, wherein the control means comprises tilt detection means for detecting tilt or an angle of the elongate member.

30. A seesaw as claimed in claim 28, wherein the control means controls or switches the illumination means such that the illumination means on one end of the elongate member are off or not illuminated when the one end is up, and one or more illumination means on the other end of the elongate member is/are on or illuminated when the other end is down.

31. A seesaw as claimed in claim 30, wherein, in use, when the one end is moved down and the other end is moved up, the illumination means on the one end switches on, and the illumination means at the other end switches off.

32. A seesaw as claimed in claim 28, wherein the illumination means are controlled or selectively or switchably controlled by the control means independent of the orientation or tilt of the elongate member.

33. A seesaw as claimed in claim 32, wherein illumination means are, in use, caused to operate sequentially.

34. A seesaw as claimed in claim 1, wherein, in use, when illuminated the illumination means illuminate continuously or intermittently.

35. A seesaw as claimed in claim 1, wherein there are provided further illumination means on or adjacent one or both ends of the elongate member which further illumination means are illuminated continuously or are caused to flash, in use, optionally in a similar manner to illumination means on said end.

36. A seesaw as claimed in claim 1, wherein the illumination means are powered by one or more batteries or cells.

37. A seesaw as claimed in claim 1, wherein the illumination means are powered by solar power means.

38. A seesaw as claimed in claim 1, wherein a/the seat(s) is/are made from plastic or alternatively wood.

* * * * *